United States Patent [19]

Franks

[11] 4,001,800

[45] Jan. 4, 1977

[54] SMOKE DETECTING DEVICE

[75] Inventor: Jeffrey L. Franks, Holland, Mich.

[73] Assignee: Gentex Company, Holland, Mich.

[22] Filed: May 19, 1975

[21] Appl. No.: 578,612

Related U.S. Application Data

[63] Continuation-in-part of Ser. No. 482,435, June 24, 1974, abandoned.

[52] U.S. Cl. ..... 340/237 S; 250/552; 250/574

[51] Int. Cl.[2] ..... G08B 17/10

[58] Field of Search ..... 340/237 S; 250/552, 250/573, 574, 575, 210; 356/206, 207

[56] References Cited

UNITED STATES PATENTS

| | | | |
|---|---|---|---|
| 2,832,946 | 4/1958 | Beck | 340/228 R |
| 3,297,913 | 1/1967 | Schweitzer, Jr. | 317/36 |
| 3,316,410 | 4/1967 | Meili et al. | 340/237 S X |
| 3,409,885 | 11/1968 | Hall | 340/237 S X |
| 3,460,124 | 8/1969 | Smith et al. | 340/237 S |
| 3,534,351 | 10/1970 | Harnden, Jr. et al. | 340/237 S |
| 3,594,751 | 7/1971 | Ogden et al. | 340/237 S X |
| 3,713,128 | 1/1973 | Wong et al. | 340/237 S X |
| 3,728,706 | 4/1973 | Tipton et al. | 340/237 S |
| 3,774,186 | 11/1973 | Enemark | 340/237 S |
| 3,922,655 | 11/1975 | Lecuyer | 340/237 S |

*Primary Examiner*—John W. Caldwell
*Assistant Examiner*—Daniel Myer
*Attorney, Agent, or Firm*—Malcolm R. McKinnon

[57] ABSTRACT

A smoke detector and alarm system incorporating means for detecting airborne particles of smoke and activating an alarm for fire warning purposes, the system including an illuminating circuit having a light emitting diode therein, a smoke sensing and compensation circuit having a pair of photo-electric cells incorporated therein, a comparator and a trigger circuit, and an alarm circuit.

30 Claims, 3 Drawing Figures

100
R17
1103
Node 44
R18
1104
D12
122
170
1102
1107
1105
1113
R15
138
1114
R16
1115
PC-12
Q13
1111
1106
124
126
1108
1109
1110
128
130
PC-11
1112
D11
118
116
132
Q12
134
140
R13
1116
1117
R14
1118
Node 53
1119
1122
R12
1123
1115
1140
1120
Q11
142
144
148
146
1121
1101
1128
R19
1129
C11
1127
1130
1125
R11
1124
1132
150
1126
112
120 V.A.C. 60Hz.
114

SMOKE DETECTING DEVICE

This application is a continuation-in-part of the applicant's co-pending application, Ser. No. 482,435, filed June 24, 1974 for Smoke Detector and Alarm System, now abandoned.

BRIEF SUMMARY OF THE INVENTION

This invention relates to smoke detectors and, more particularly, to an improved self-contained smoke detector and alarm system incorporating improved means for detecting airborne particles of smoke and activating an alarm for fire warning purposes.

Heretofore, photo-electric type smoke detectors have been utilized for the purpose of detecting smoke and activating an alarm to alert the occupants of a building to the danger of fire. However, prior smoke detectors of the indicated character typically have a common deficiency in that an internal illuminating device located in the detection head thereof is often in the form of an incandescent light bulb which may fail at any time. Consequently, because of this inherent deficiency, manufacturers have been obligated to supply extra replacement light bulbs, and it has also been a common practice to provide a special electrical circuit for the purpose of indicating that the light bulb has burned out or otherwise failed. Moreover, the owners or users of such prior photo-electric type smoke detectors have been expected to replace the burned out light bulbs themselves, and the replacement procedure requires disassembly of the device with the result that the manufacturer also usually incorporates a step down transformer in the circuitry of minimize the possibility of an electrical shock hazard during the light bulb changing operation. As is well known to those skilled in the art, electrical transformers are relatively expensive, bulky and heavy and increase the possibility of damage to the electrical circuitry if and when the smoke detector is jarred or otherwise subjected to mechanical shocks. In addition, the manufacturers of prior smoke detectors of the indicated character have usually found it necessary to provide interlocks, disconnects, switches and special caution labels for the purpose of limiting potential electric shock hazards. It will also be appreciated that while the manufacturers of prior smoke alarms have tended to assume that the users of their products are capable of readily changing the incandescent light bulbs utilized therein, from a practical standpoint, all of the persons involved do not possess the mechanical ability or intellect required to disassemble the unit, replace the incandescent light bulb, and reassemble the unit in a safe manner with the result that the users have been obligated to employ trained service personnel for the purpose of servicing the units with a consequent increase in the cost of using the product.

Other prior smoke detectors which incorporate illuminating devices in the form of light emitting diodes that operate in conjunction with photo-electric cells fail to provide means to compensate for variations in light output of the light emitting diodes due to temperature changes, voltage variations and age, and/or to compensate for the temperature coefficient of the photo-electric cells, thereby reducing the reliability and service life of such prior smoke detectors. In addition, prior smoke detectors of the photo-electric type often require the use of complicated lens systems for focusing light onto a photo-electric cell embodied in such devices, thereby increasing the initial cost thereof. Moreover, prior smoke detector units often either cannot be electrically connected together, or require complicated and expensive wiring, to provide a multiple alarm system whereby all units in the system sound an alarm when one or more units in the system detect smoke.

An object of the present invention is to overcome the aforementioned as well as other disadvantages in prior smoke detectors of the indicated character and to provide an improved smoke detector system incorporating improved means for detecting airborne particles of smoke and activating a fire alarm.

Another object of the invention is to provide an improved smoke detector system which eliminates the necessity of providing incandescent light bulbs in the circuitry thereof thereby eliminating light bulb replacement operations requiring disassembly and reassembly of the smoke detector unit.

Another object of the present invention is to provide an improved smoke detector system comprising a light emitting diode and a pair of photo-electric cells and also including improved means for compensating for variations in light output of the light emitting diode due to temperature changes, voltage variations and age, as well as means for compensating for the temperature coefficient of the photo-electric cells.

Another object of the present invention is to provide an improved smoke detector system having a service life sufficiently long that the user is not obligated to be exposed to dangerous electrical shock hazards.

Another object of the invention is to provide an improved smoke detector system which obivates the necessity of providing complicated light focusing lens systems, or special electrical circuits to monitor or supervise an illuminating device such as an incandescent light bulb or a light emitting diode, and which also obviates the necessity of providing relatively heavy, bulky and expensive transformers, special interlocks, disconnects, switches and special caution labels.

Another object of the invention is to provide an improved smoke detector system incorporating improved solid state electrical circuitry having a long service life, which operates with a minimum of internal light, and which is effective to detect airborne smoke particles of a predetermined density and energizes a fire alarm.

Another object of the invention is to provide an improved smoke detector system incorporating improved means assuring fail-safe operation of the system.

Another object of the present invention is to provide an improved smoke detector system which may incorporate novel multiple smoke detection units that may be easily and economically electrically connected together whereby all units in the system sound an alarm when one or more units in the system detect smoke.

Still another object of the invention is to provide an improved smoke detector system that is economical to manufacture and assemble, durable, efficient and reliable in operation.

The above as well as other objects and advantages of the present invention will become apparent from the following description, the appended claims and the accompanying drawings.

BRIEF DESCRIPTION OF THE DRAWINGS

FIG. 3 is a schematic electrical circuit diagram of a smoke detector system and illustrating another embodiment of the present invention.

DETAILED DESCRIPTION

Figure 1:
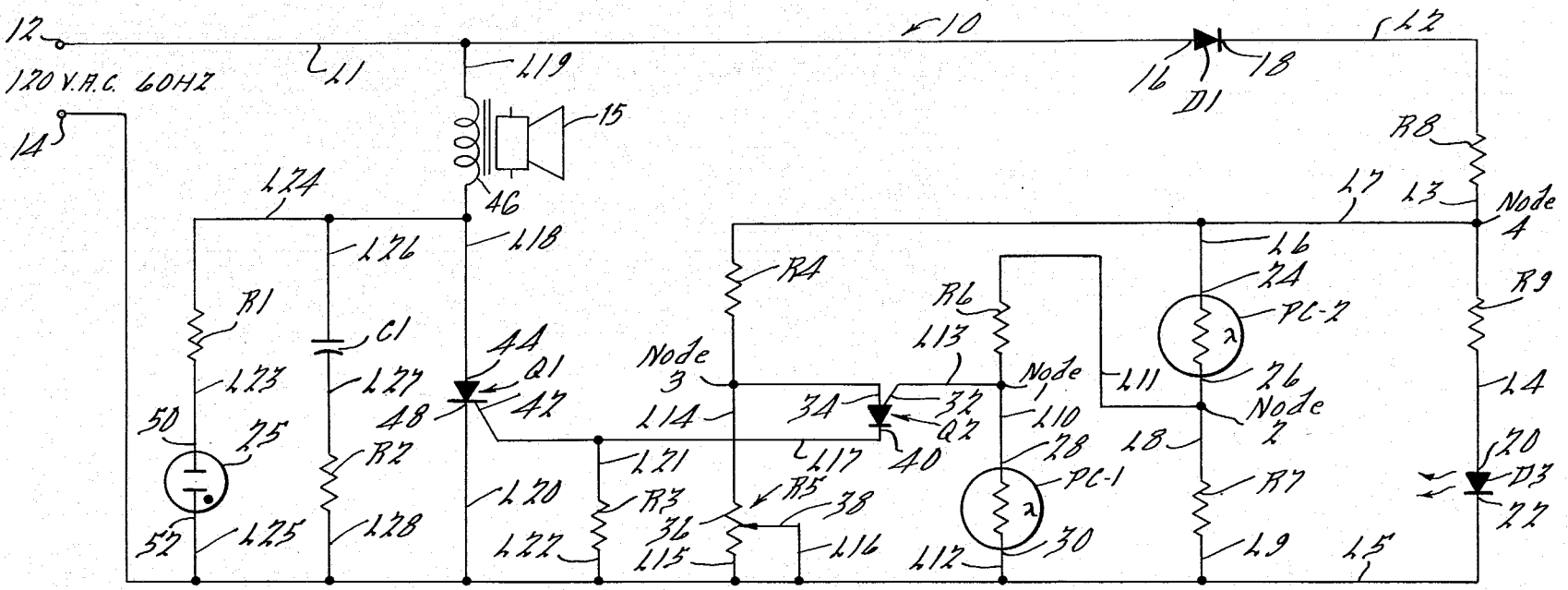
FIG. 1 is a schematic electrical circuit diagram of a smoke detector system and illustrating one embodiment of the present invention.

Referring to the drawings, and more particularly to FIG. 1 thereof, the circuitry for one embodiment of a smoke detector system, generally designated 10, embodying the present invention is schematically illustrated therein. As shown in FIG. 1, the system 10 is provided with electrical terminals 12 and 14 adapted to be connected to a conventional source of 120 volt, 60 cycle alternating current, as for example, a conventional wall outlet in a home or a commercial building. The system 10 also includes an electrical horn 15, a neon lamp 25, a disc capacitor C1, a silicon controlled rectifier Q1, a programmable unijunction transistor Q2, a diode D1, identical photo-electric cells PC1 and PC2, a light emitting diode D3, resistors R1, R2, R3 and R4, a potentiometer R5, and resistors R6, R7, R8 and R9.

As shown in FIG. 1, the terminal 12 is connected to the anode 18 of the diode D1 by the lead L1 while the cathode 18 of the diode D1 is connected through the resistors R8 and R9 to the terminal 20 of the light emitting diode D3 by the leads L2, L3 and L4. The terminal 22 of the light emitting diode D3 is connected to the terminal 14 by the lead L5.

As shown in FIG. 1, a smoke sensing and compensation circuit is provided comprised of the identical photo-electric cells PC1 and PC2, and the resistors R6 and R7. The terminal 24 of the photo-electric cell PC2 is connected by the leads L6 and L7 to the lead L3 at the node 4 intermediate the resistors R8 and R9 while the terminal 26 if the photo-electric cell PC2 is connected through the resistor R7 by the leads L8 and L9 to the lead L5. The terminal 28 of the photo-electric cell PC1 is connected by the leads L10 and L11 through the resistor R6 to the lead L8 at the node 2 intermediate the terminal 26 of the photo-electric cell PC2 and the resistor R7 while the terminal 30 of the photo-electric cell PC1 is connected to the lead L5 by the lead L12.

The system 10 also includes a comparator and a trigger circuit comprised of the programmable unijunction transistor Q2, the resistor R4 and the potentiometer R5. The gate 32 of the programmable unijunction transistor Q2 is connected by the lead L13 to the lead L10 at the node 1 intermediate the resistor R6 and the terminal 28 of the photo-electric cell PC1 while the anode 34 of the programmable unijunction transistor Q2 is connected to the lead L14 at the node 3 intermediate the resistor R4 and the potentiometer R5. The resistor R4 in turn is connected to the node 4 of the lead L3 by the lead L7. The lead L14 is connected through the carbon composition 36 of the potentiometer R5 to the lead L5 by the lead L15 while the movable contact 38 of the potentiometer R5 is connected to the lead L5 by the lead L16. The cathode 40 of the programmable unijunction transistor Q2 is connected to the gate 42 of the silicon controlled rectifier Q1 by the lead L17.

The system 10 also includes an alarm horn and lamp circuit comprised of the horn 15, neon lamp 25, resistors R1, R2 and R3, capacitor C1 and the silicon controlled rectifier Q1. The anode 44 of the silicon controlled rectifier Q1 is connected through the coil 46 of the horn 15 to the lead L1 by the leads L18 and L19 while the cathode 48 of the silicon controlled rectifier Q1 is connected to the lead L5 by the lead L20, and the resistor R3 is connected between the leads L17 and L5 by the leads L21 and L22. The terminal 50 of the neon lamp 25 is connected through the resistor R1 to the lead L18 by the leads L23 and L24 while the terminal 52 of the neon lamp 25 is connected by the lead L25 to the lead L5. The capacitor C1 and resistor R2 are connected between the leads L24 and L5 by the leads L26, L27 and L28 and form a snubber network to prevent high energy transients from the power line from destroying the silicon controlled rectifier Q1.

Figure 2:
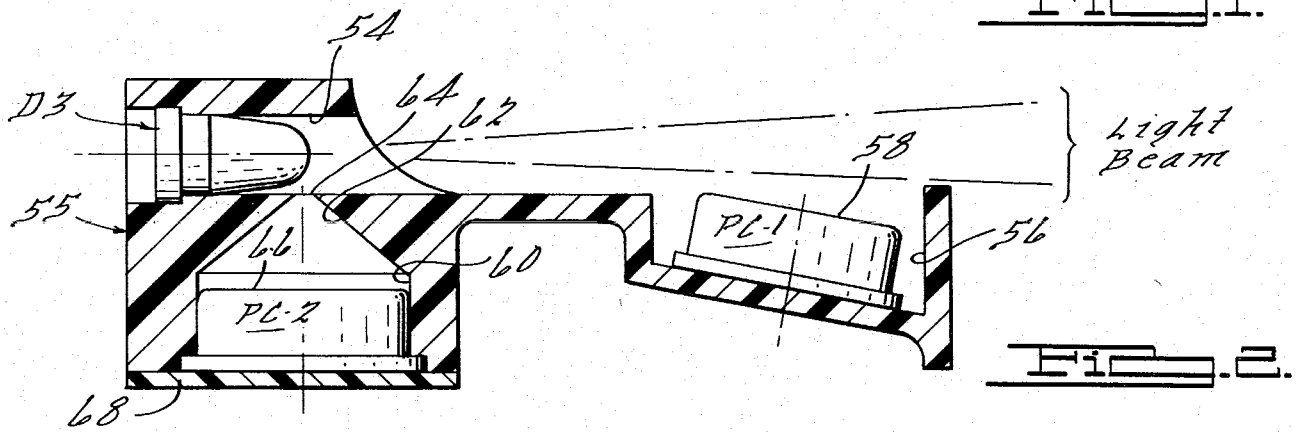
FIG. 2 is a longitudinal sectional view of a smoke detecting head incorporated in the system illustrated in FIG. 1.
Figure 2:
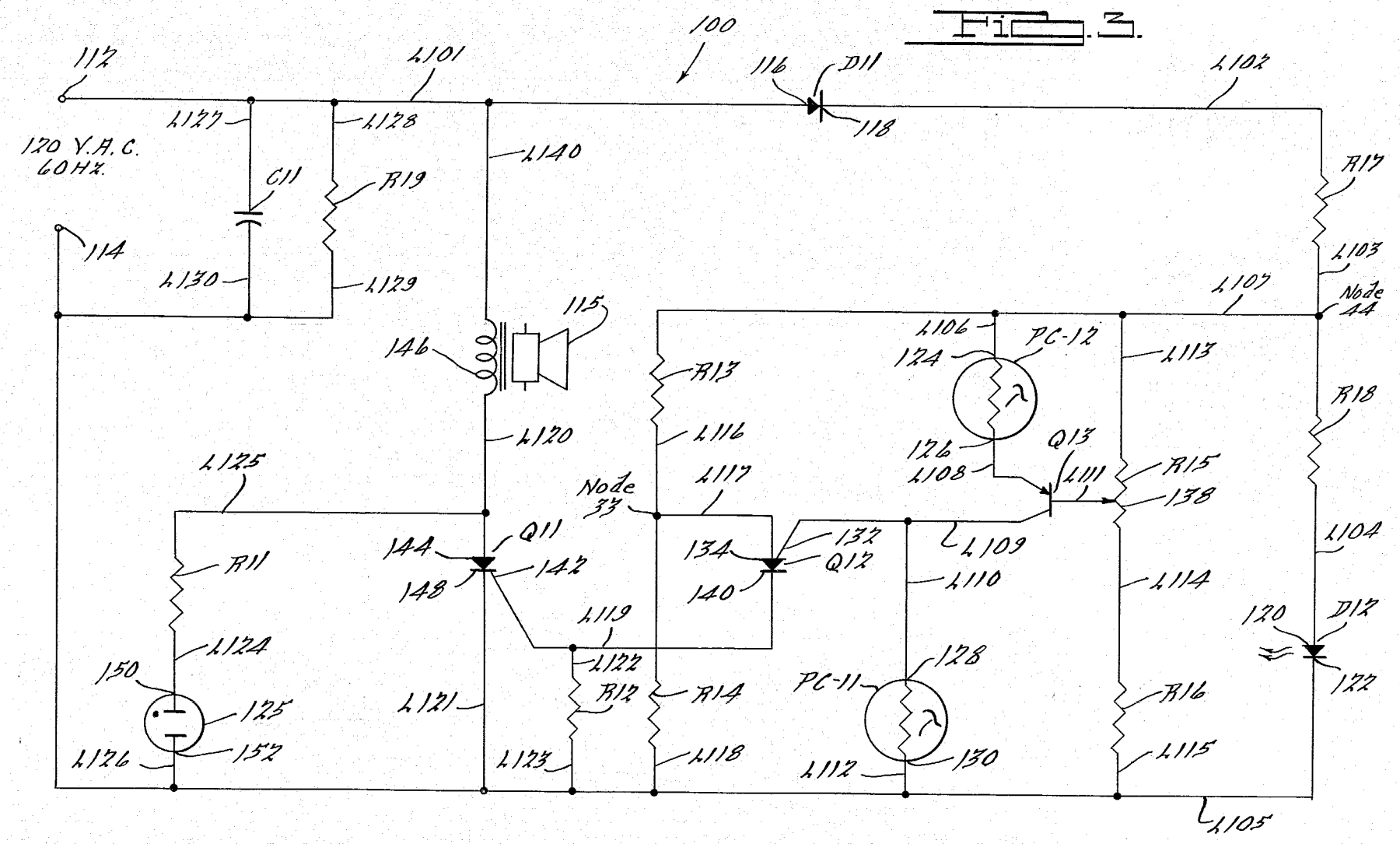

As shown in FIG. 2, in a preferred embodiment of the invention, the light emitting diode D3 is mounted in a longitudinally extending passageway 54 defined by a sensing head housing, generally designated 55. The sensing head housing 55 also defines a chamber 56 which is open at the top, as viewed in FIG. 2, and the photo-electric cell PC1 is mounted in the chamber 56 so that the active face 58 thereof is in an exposed position. However, as schematically illustrated in FIG. 2, when there is no smoke (airborne particulate matter) in the ambient air, the light emanating from the light emitting diode D3 is not reflected onto the active face 58 of the smoke sensing photo-electric cell PC1. The sensing head housing 55 also defines a chamber 60 in which the photo-electric cell PC2 is mounted, the upper portion 62 of the chamber 60 being generally conical in shape and providing a small opening 64 communicating with the passageway 54 whereby the active face 66 of the photo-electric cell PC2 is exposed at all times to any light emanating from the light emitting diode D3. The chamber 60 is closed by an end wall 68 to prevent ingress of smoke particles into the chamber 60. The sensing head 55 and all of the aforementioned electrical components with the exception of the horn 15 and neon light 25 are preferably mounted on a circuit board, which may be integrated, the circuit board in turn being mounted in a housing (not shown) which is light tight but which permits ambient air to circulate therethrough, whereby any smoke particles present in the ambient air will circulate through the light beam emanating from the light emitting diode D3 and projecting over the face 58 of the photo-electric cell PC1. The horn 15 and the neon light 25 may also be mounted in the aforementioned housing in a manner such that sound emanating from the horn may be readily heard by any persons in the vicinity and the neon light readily perceived so as to indicate to persons viewing the same that the system 10 is operating. The neon light 25 should, of course, be mounted so that light emanating therefrom will not impinge upon the photo-electric cells PC1 and PC2.

As previously mentioned, when there is no smoke (airborne particulate matter) in the ambient air, no light emanating from the light emitting diode D3 is reflected onto the active face 58 of the smoke sensing photo-electric cell PC1. However, when smoke is introduced into the ambient air in the path of the light beam emanating from the light emitting diode D3, light is reflected from the smoke particles in all directions. Some of the reflected light impinges upon the active face 58 of the photo-electric cell PC1 under these conditions and increases the conductivity of the photo-electric cell PC1 with the result that the horn 15 will be activated as will be described hereinafter in greater detail.

Typical values for the components of the system 10 described above are as follows:

| | |
|---|---|
| 15 | Horn No. 16103117 - Delta |
| C1 | .002 MFD 600 V Disc Capacitor |
| D1 | IN4004 Diode |
| D3 | XMV5018 L. E. D. Monsanto or FLV-104 Fairchild |
| 25 | NE-2H Neon Lamp |
| PC1 and PC2 | Series 5M, Type 5 material - Clairex |
| Q1 | C107 SCR |
| Q2 | 2N6027 PUT |
| R1 | 120,000 OHM ½ w ± 10% C.C. Resistor |
| R2 | 680 OHM ½ w ± 10% C.C. Resistor |
| R3 | 1000 OHM ½ w ± 10% C.C. Resistor |
| R4 | 6800 OHM ½ w ± 10% C.C. Resistor |
| R5 | 5000 OHM Potentiometer - CTS |
| R6 | 1.5 Meg OHM Approx. |
| R7 | 100,000 OHM Approx. |
| R8 | 3000 OHM 5 watt ± 10% WW Resistor |
| R9 | 470 OHM ½ watt ± 10% C.C. Resistor |

It will be understood, however, that these values may be varied depending upon the particular application of the principles of the present invention.

In the operating of the system 10, the terminals 12 and 14 are connected to a suitable source of 120 volt, 60 cycle alternating current, such as a conventional wall outlet. When the terminals 12 and 14 are connected to the source of AC power, the neon light 25 is immediately energized to indicate that the system is powered and armed. If the neon light is not energized, there is either no power going to the system or the horn 15 is open circuited. Thus the energization of the neon light 25 also indicates that there is electrical continuity through the coil 46 of the horn 15, and the neon light will not be energized if the horn is or subsequently becomes open circuited.

The 120 volt alternating current power is rectified by the diode D1 to provide positive half wave pulses. The resistors R8 and R9 limit the current through the light emitting diode D3 to a safe amount, approximately plus 50 MA PK half wave current. The current through the light emitting diode D3 forward biases its diode junction, so that the light emitting diode emits light, the light emitting diode D3 turning on and off 60 times a second in step with the power line frequency. Since D3 is a diode, very little positive voltage appears across the device, typically plus 1.8 volts peak for this current. The resistors R8 and R9 also form a voltage divider to supply approximately plus 20 volt half wave pulses to the sensing and compensation circuits and the triggering circuit hereinabove described.

As previously mentioned, the photo-electric cell PC1 functions as a smoke sensing photo-cell in the manner previously described. The photo-electric cell PC2 is preferably identical to the photo-electric cell PC1 and the photo-electric cell PC2 is utilized to compensate for variations in light output of the light emitting diode D3 due to temperature changes, voltage variations and age. The photo-electric cell PC2 also compensates for the temperature coefficient of the photo-electric cell PC1. The photo-electric cell PC1 and the resistor R6 form a voltage divider, supplied from the photo-electric cell PC2 and the resistor R7. The voltage at the node 1 at the junction of the photo-electric cell PC1 and the resistor R6 will normally be steady state, unless smoke is introduced into the light beam emanating from the light emitting diode D3. When light emanating from the light emitting diode D3 is reflected by smoke particles so as to strike the active face 58 of the photo-electric cell PC1, the conductivity of PC1 increases and the peak voltage at the node 1 becomes less positive. The amount of voltage drop is directly proportional to the build up of smoke. The photo-electric cell PC1 has a positive temperature coefficient. Changes in temperature would change the node 1 voltage if it were not compensated for by the photo-electric cell PC2 which has the same temperature coefficient as the photo-electric cell PC1. As the voltage at the node 1 tends to become more positive, the voltage at the node 2 tends to become less positive. The two variations cancel each other and the voltage at the node 1 thus remains constant.

The same compensation effect described above for temperature is also true of the compensation effect for light. Since both PC1 and PC2 are common mode for temperature and light output for the light emitting diode, the compensation produces the same effect. Typical voltage divider constants for nodes 1 and 2 are as follows:

Node 1 peak voltage is equal to 0.25 node 4 peak voltage;

Node 2 peak voltage is equal to 0.5 node 4 peak voltage; and

Node 4 voltage is equal to approximately plus 20 volts peak half wave.

The node 1 peak voltage is typical for the percent obscuration per foot of smoke in the ambient atmosphere adjacent the sensing head 55 that the smoke alarm is calibrated for (typically two percent to four percent).

In the comparator and trigger circuit previously described and comprised of the programmable unijunction transistor Q2, the resistor R4 and the potentiometer R5, conduction of current from anode to cathode of the programmable unijunction transistor Q2 is possible only when the gate 32 of the programmable unijunction transistor Q2 is less positive than the anode 34 of the programmable unijunction transistor. The resistor R4 and potentiometer R5 form a voltage divider. The anode 34 of the programmable unijunction transistor Q2 is connected to the node 3 at the junction of the potentiometer R5 and resistor R4, the node 3 thus driving the anode 34 of the programmable unijunction transistor Q2. The potentiometer R5 determines the peak voltage at this point and provides a method for calibrating the sensitivity of the smoke detector system 10. Since the voltage at the node 1 becomes less positive proportional to the amount of smoke, the node 3 becomes a set point for comparison. When the voltage at the node 1 becomes slightly less positive than the voltage at node 3, the programmable unijunction transistor Q2 will be driven through its negative resistance region and then latch on and stay on for the duration of the half wave peak. A low impedance path is formed when the programmable unijunction transistor Q2 is triggered into conduction from anode to cathode that is utilized to trigger the silicon controlled rectifier Q1. The silicon controlled rectifier may be regarded as a controlled switch. When the gate 42 of Q1 is forward biased by the programmable unijunction transistor Q2, the silicon controlled rectifier Q1 conducts from anode to cathode on all positive half wave pulses. Conduction of current through the horn 15 and the silicon controlled rectifier Q1 closes the circuit and the alarm horn 15 turns on. During this condition, the voltage at the anode 44 of the silicon controlled rectifier Q1 is almost zero. When the silicon controlled rectifier Q1 is not conducting, essentially no current is flowing through the coil 46 of the horn 15, and the circuit therethrough may be considered to be open so that the horn 15 does not sound. During this condition, the voltage at the anode 44 of the silicon controlled rectifier Q1 is 120 volt AC. This voltage is sufficient to trigger the neon light 25 and the resistor R1 limits the current through the neon light 25 to a safe amount. The current through the diode D1, the horn 15, the resistor R1 and the neon light 25 is several orders of magnitude less than is required to make the horn 15 sound. However, the neon light 25 indicates that the system 10 is powered, that the detector is armed, and that there is electrical continuity through the horn 15. As previously mentioned, the resistor R2 and the capacitor C1 form a snubber network to prevent high energy transients from the power line from destroying the silicon controlled rectifier Q1. The resistor R3 is used to stabilize the characteristics of the silicon controlled rectifier Q1 so that the silicon controlled rectifier Q1 will remain stable under extreme conditions.

It will be appreciated that under the conditions in which it is utilized in the system 10, the light emitting diode D3 is inherently stable and may be expected to have a service life in excess of thirty years. However, if the light emitting diode D3 should fail for any reason, as for example, due to an open circuit in the lead L4, then no light will strike the active face 66 of the photoelectric cell PC2 and the conductivity of PC2 will decrease and, in effect, open the circuit to the node 2, (due to the very high resistance of the photo-electric cell PC2 when light is not impinging thereon) thereby cutting off power to node 1. When the node 1 voltage goes below the node 3 voltage, the programmable unijunction transistor Q2 fires to gate the silicon controlled rectifier Q1, whereupon the silicon controlled rectifier Q1 conducts from anode to cathode and the alarm horn 15 turns on thus indicating that a failure of the light emitting diode D3 has occurred.

It will also be appreciated by those skilled in the art that the photo-electric cell PC2 could be inserted in the position in the circuit occupied by the resistor R5 and that with appropriate component value changes, the system 10, as so modified, would achieve results similar to those previously described.

The neon lamp 25 is also very stable under the conditions in which it is utilized in the system 10 and may be expected to have a normal service life of between ten and twenty years while the remaining components of the system can be expected to have a service life in excess of the service life of the neon lamp 25. Thus it will be appreciated that the users of the system 10 will not be required or expected to service the system themselves and that the system 10 eliminates the necessity of end users being required to periodically disassemble the unit, replace an incandescent light bulb and reassemble the unit thereby eliminating the possibility of the end user being exposed to dangerous electrical shock hazards. The system 10 also eliminates the need for special electrical circuits for the purpose of monitoring an illuminating device such as an incandescent light bulb or a light emitting diode and providing an alert when the illuminating device fails; eliminates the need for heavy, bulky and relatively expensive transformers; and also eliminates the need for special interlocks, disconnects, switches and special caution labels. From the foregoing description, it will also be appreciated that the compensation circuit incorporated in the system 10 compensates for both temperature changes and light output variations of the light emitting diode; that the anode and gate circuits of the programmable unijunction transistor cancel common mode power supply variations; and that the programmable unijunction transistor triggering circuit does not require the use of a capacitor.

Another embodiment of the present invention is schematically illustrated in FIG. 3. As shown in FIG. 3, a smoke detector system, generally designated 100, is provided which includes electrical terminals 112 and 114 adapted to be connected to a conventional source of 120 volt, 60 cycle alternating current, as for example, a conventional wall outlet in a home or a commercial building. The system 100 also includes an electrical horn 115, a neon lamp 125, a film type capacitor C11, a silicon controlled rectifier Q11, a programmable unijunction transistor Q12, a diode D11, identical photo-electric cells PC11 and PC12, a light emitting diode D12, resistors R11, R12, R13 and R14, a potentiometer R15, resistors R16, R17, R18 and R19, and a transistor Q13.

As shown in FIG. 3, the terminal 112 is connected to the anode 116 of the diode D11 by the lead L101 while the cathode 118 of the diode D11 is connected through the resistors R17 and R18 to the terminal 120 of the light emitting diode D12 by the leads L102, L103 and L104. The terminal 122 of the light emitting diode D12 is connected to the terminal 114 by the lead L105, to complete an illuminating circuit.

As shown in FIG. 3, a smoke sensing and compensation circuit is provided comprised of the identical photo-electric cells PC11 and PC12, the potentiometer R15, the resistor R16 and the transistor Q13. The terminal 124 of the photo-electric cell PC12 is connected by the leads L106 and L107 to the lead L103 at the node 44 intermediate the resistors R17 and R18 while the terminal 126 of the photo-electric cell PC12 is connected to the emitter 127 of the transistor Q13 by the lead L108. The collector of the transistor Q13 is connected to the terminal 128 of the photo-electric cell PC11 by the leads L109 and L110 while the base of the transistor Q13 is connected to the movable contact 138 of the potentiometer R15 by the lead L111. The terminal 130 of the photo-electric cell PC11 is connected to the lead L105 by the lead L112, while the carbon composition of the potentiometer R15 is connected to the lead L107 by the lead 113 and through the resistor R16 to the lead 105 by the leads L114 and L115.

The system 100 also includes a comparator and a trigger circuit comprised of the programmable unijunction transistor Q12, and the resistors R12, R13 and R14. The gate 132 of of the programmable unijunction transistor Q12 is connected by the lead L109 to the collector of the transistor Q13 while the anode 134 of the programmable unijunction transistor Q12 is connected to the lead L116 at the node 33 intermediate resistors R13 and R14 by the lead L117. The resistor R13 in turn is connected to the node 44 of the lead L103 by the lead L107. The lead L116 is connected through the resistor R14 to the lead L105 by the lead L118, while the cathode 140 of the programmable unijunction transistor Q12 is connected to the gate 142 of the silicon controlled rectifier Q11 by the lead L119.

The system 100 is also comprised of an alarm horn and lamp circuit which includes the horn 115, the neon lamp 125, the resistors R11 and R12 and the silicon controlled rectifier Q11. The anode 144 of the silicon controlled rectifier Q11 is connected through the coil 146 of the horn 115 to the lead L101 by the leads L120 and L140 while the cathode 148 of the silicon controlled rectifier Q11 is connected to the lead L105 by the lead L121, and the resistor R12 is connected between the leads L119 and L105 by the leads L122 and L123. The terminal 150 of the neon lamp 125 is connected through the resistor R11 to the lead L120 by the leads L124 and L125 while the terminal 152 of the neon lamp 125 is connected by the lead L126 to the lead L105. The capacitor C11 and resistor R19 are connected between the leads L101 and L105 by the leads L127, L128, L129 and L130, as shown in FIG. 3, the capacitor C11 being an A. C. line bypass capacitor which prevents high frequency line noise from reaching the detector.

In this embodiment of the invention, the light emitting diode D12 may be mounted in the longitudinally extending passageway 54 defined by the sensing head housing, generally designated 55, illustrated in FIG. 2 and previously described, the light emitting diode D12 being substituted for the light emitting diode D3. As previously mentioned, the sensing head housing 55 also defines a chamber 56 which is open at the top, as viewed in FIG. 2, and the photo-electric cell PC11 is mounted in the chamber 56 in the same manner that the photo-electric cell PC1, previously described, is mounted in the chamber 56 so that the active face of the photo-electric cell PC11 is in an exposed position. However, when there is no smoke (airborne particulate matter) in the ambient air, the light emanating from the light emitting diode D12 is not reflected onto the active face of the smoke sensing photo-electric cell PC11. As previously described, the sensing head housing 55 also defines a chamber 60 and the photo-electric cell PC12 may be mounted therein in the same manner that the photo-electric cell PC2 is mounted therein. Since the upper portion 62 of the chamber 60 is generally conical in shape and provides a small opening 64 which communicates with the passageway 54, the active face of the photo-electric cell PC12 is thus exposed at all times to any light emanating from the light emitting diode D12, the chamber 60 being closed by the end wall 68 to prevent ingress of smoke particles into the chamber 60. In this embodiment of the invention, the sensing head 55 and all of the aforementioned electrical components with the exception of the horn 115 and the neon light 125 are preferably mounted on a circuit board, which may be integrated, the circuit board in turn being mounted in a housing (not shown) which is light tight but which permits ambient air to circulate therethrough, whereby any smoke particles present in the ambient air will circulate through the light beam emanating from the light emitting diode D12 and projecting over the active face of the photo-electric cell PC11. The horn 115 and the neon light 125 may also be mounted in the aforementioned housing in a manner such that sound emanating from the horn may be readily heard by any persons in the vicinity and the neon light 125 readily perceived so as to indicate to persons viewing the same that the system 100 is operating. The neon light 125 should, of course, be mounted so that light emanating therefrom will not impinge upon the photo-electric cells PC11 and PC12.

As previously mentioned, when there is no smoke (airborne particulate matter) in the ambient air, no light emanating from the light emitting diode D12 is reflected onto the active face of the smoke sensing photo-electric cell PC11. However, when smoke is introduced into the ambient air in the path of the light beam emanating from the light emitting diode D12, light is reflected from the smoke particles in all directions. Some of the reflected light impinges upon the active face of the photo-electric cell PC11 under these conditions and increases the conductivity of the photo-electric cell PC11 with the result that the horn 115 will be activated as will be described hereinafter in greater detail.

Typical values for the components of the system 100 described above are as follows:

| | |
|---|---|
| C11 | Capacitor, Film Type, 0.47 MFD, 400 V., 85° C. |
| R11 | Resistor, 270,000 OHM, ½ w. or 120,000, ½ w. |
| R12 | Resistor, 1000 OHM, ½ w. |
| R13 | Resistor, 6800 OHM, ½ w. |
| R14 | Resistor, 1800 OHM, ½ w. |
| R16 | Resistor, 2700 OHM, ½ w. |
| R17 | Resistor, 3000 OHM, 5 w. ± 10% |
| R18 | Resistor, 470 OHM, ½ w. |
| R19 | Resistor, 120,000 OHM, ½ w. |
| R15 | Potentiometer, 5000 OHM ¼ w. |
| Q13 | Transistor, Silicon, Type 2N6076 (or equivalent) |
| Q12 | Programmable Unijunction Transistor, Silicon Type 2N6027 (or equivalent) |
| Q11 | Silicon Controlled Rectifier, C106 or C107 (or equivalent) Min. 200 V. V Fxm |
| D11 | Diode, Silicon, Type 1N4004 (or equivalent), Rated 400 PIV, 1 AMP, 75° C. |
| D12 | Diode, Light Emitting, GaAsP, FAIRCHILD FLV-111 Rated 2 PIV, .05 AMP, 100° C. |
| 125 | NE-2H, Neon Lamp |
| PC11 and PC12 | Photocells, CLAIREX No. CL7049, or NATIONAL No. NSL-293 (or equivalent) |
| 115 | Horn, EDWARDS No. 1236 or DELTA No. 16003147 (or equivalent) 120 VAC. |

As indicated in the table hereinabove, the light emitting diode D12 is preferably a light emitting diode comprised of Gallium Arsenide Phosphide (GaAsP). The light emitting diode D12 is thus more reliable, more stable and less costly than other light emitting diodes such as Gallium Phosphide light emitting diodes. Moreover, the reliability and stability of Gallium Arsenide Phosphide light emitting diodes eliminates any requirements for monitoring or supervising the light emitting diode D12 and contributes to a substantial reduction in cost of the smoke detector and alarm system 100.

It will be understood that the values in the above table may be varied depending upon the particular application of the principles of the present invention.

In the operation of the system 100, the terminals 112 and 114 are connected to a suitable source of 120 volt, 60 cycle, alternating current, such as a conventional wall outlet. When the terminals 112 and 114 are connected to the source of AC power, the neon light 125 is immediately energized to indicate that the system is powered and armed. If the neon light is not energized, there is either no power going to the system or the horn 115 is open circuited. Thus the energization of the neon light 125 also indicates that there is electrical continuity through the coil 146 of the horn 115, and the neon light 125 will not be energized if the horn 115 is or subsequently becomes open circuited.

The 120 volt alternating current power is rectified by the diode D11 to provide positive half wave pulses. The resistors R17 and R18 limit the current through the light emitting diode D12 to a safe amount, approximately plus 50 MA PK half wave current. The current through the light emitting diode D12 forward biases its diode junction, so that the light emitting diode D12 emits light, the light emitting diode D12 turning on and off 60 times a second in step with the power line frequency. Since D12 is a diode, very little positive voltage appears across the device typically plus 1.8 volts peak for this current. The resistors R17 and R18 also form a voltage divider to supply approximately plus 20 volt half wave pulses to the sensing and compensation circuits and the triggering circuit hereinabove described.

As previously mentioned, the photo-electric cell PC11 functions as a smoke sensing photo-cell in the manner previously described. The photo-electric cell PC12 is preferably identical to the photo-electric cell PC11 and the photo-electric cell PC12 is utilized to compensate for variations in light output of the light emitting diode D12 due to temperature changes, voltage variations and age. The photo-electric cell PC12 also compensates for the temperature coefficient of the photo-electric cell PC11. The photo-electric cell PC12, the transistor Q13, the potentiometer R15 and the resistor R16 form a constant current source that is adjustable. The potentiometer thus becomes the smoke calibration control for the system 100. The photo-electric cell PC12 thus has an effect on the amount of current supplied to the smoke sensing photo-electric cell PC11, and the photo-electric PC12 thus compensates for changes in light output of the light emitting diode D12 and also compensates for the temperature coefficient of the photo-electric cell PC11. When light emanating from the light emitting diode D12 is reflected by smoke particles so as to strike the active face of the photo-electric cell PC11, the conductivity of PC11 increases and the peak voltage at the junction of the photo-electric cell PC11 and the collector of the transistor Q13 will be modulated. The junction of the photo-electric cell PC11 and the collector of the transistor Q13 thus becomes a reference point for the amount of smoke by measuring the peak voltage. The amount of voltage drop is directly proportional to the build up of smoke. Since the photo-electric cell PC11 has a positive temperature coefficient, changes in temperature would change such peak voltage if it were not compensated for by the photo-electric cell PC12 which has the same temperature coefficient as the photo-electric cell PC11. Thus, for example, if the resistance of the photo-electric cell PC11 tends to become higher, which would allow the peak voltage at the junction of the photo-electric cell PC11 and the collector of the transistor Q13 to increase, then the photo-electric cell PC12 exhibits an equal change, and the resistance of the photo-electric cell PC12 becomes higher thereby allowing less current to flow through the transistor Q13 and causing the peak voltage at the junction of the photo-electric cell PC11 and the collector of the transistor Q13 to decrease. The two changes cancel each other causing no net change in peak voltage at the junction of the photo-electric cell PCll and the collector of the transistor Q13.

The same compensation effect described above for temperature is also true of the compensation effect for light. Since both PC11 and PC12 are common mode for temperature and light output of the light emitting diode D12, the compensation produces the same effect.

The comparator and trigger circuit previously described is comprised of the programmable unijunction transistor Q12, and the resistors R12, R13 and R14. This circuit senses the peak voltage at the junction of the photo-electric cell PC11 and the collector of the transistor Q13, and functions to trigger the silicon controlled rectifier Q11 into conduction. The resistors R13 and R14 form a voltage divider that provides a reference voltage for the programmable unijunction transistor Q12 to compare against. When the peak voltage at the gate 132 of the programmable unijunction transistor Q12 drops below the peak voltage at the anode 134 of the programmable unijunction transistor Q12, then the programmable unijunction transistor Q12 is foward biased and conducts from anode to cathode and through the resistor R12 to the common lead L105 and also through the gate 142 of the silicon controlled rectifier Q11 to the common lead L105, thus triggering the silicon controlled rectifier Q11. The programmable unijunction transistor is thus driven through its negative resistance region and latches on and stays on for the duration of the half-wave peak, the low impedance path formed when the programmable unijunction transistor Q12 is triggered into conduction from anode to cathode being utilized to trigger the silicon controlled rectifier Q11. The silicon controlled rectifier may be regarded as a controlled switch. When the gate 142 of Q11 is forward biased by the programmable unijunction transistor Q12, the silicon controlled rectifier Q11 conducts from anode to cathode on all positive half wave pulses. Conduction of current through the horn 115 and the silicon controlled rectifier Q11 closes the circuit and the alarm horn 115 turns on.

When the silicon controlled rectifier Q11 is not conducting, essentially no current is flowing through the coil 146 of the horn 115, and the circuit therethrough may be considered to be open so that the horn 115 does not sound. During this condition, the voltage at the anode 144 of the silicon controlled rectifier Q11 is 120 volt AC. This voltage is sufficient to trigger the neon light 125 and the resistor R11 limits the current through the neon light 125 to a safe amount. The current through the diode D11, the horn 115, the resistor R11 and the neon light 125 is several orders of magnitude less than is required to make the horn 115 sound. However, the neon light 125 indicates that the system 100 is powered, that the detector is armed, and that there is electrical continuity through the horn 115. As previously mentioned, the capacitor C11 is an AC line bypass capacitor preventing high frequency line noise from reaching the detector. The resistor R12 is used to stabilize the characteristics of the silicon controlled rectifier Q11 so that the silicon controlled rectifier Q11 will remain stable under extreme conditions.

It will be appreciated that under the conditions in which it is utilized in the system 100, the light emitting diode D12 is inherently stable and may be expected to have a service life in excess of 30 years. However, if the light emitting diode D12 should fail for any reason, as for example, due to an open circuit in the lead L104, then no light will strike the active face of the photo-electric cell PC12 and the conductivity of PC12 will decrease and, in effect, open the circuit to the emitter of the transistor Q13 (due to the very high resistance of the photo-electric cell PC12 when light is not impinging thereon) thereby cutting off power to the junction of the photo-electric cell PC11 with the collector of the transistor Q13. When the peak voltage at the gate 132 of the programmable unijunction transistor Q12 drops below the peak voltage at the anode 134 of the programmable unijunction transistor then the programmable unijunction transistor Q12 fires to gate the silicon controlled rectifier Q11, whereupon the silicon controlled rectifier Q11 conducts from anode to cathode and the alarm horn 115 turns on thus indicating that a failure of the light emitting diode D12 has occurred.

The neon lamp 125 is also very stable under the conditions in which it is utilized in the system 100 and may be expected to have a normal service life of between 10 and 20 years while the remaining components of the system can be expected to have a service life in excess of the service life of the neon lamp 125. Thus it will be appreciated that the users of the system 100 will not be required or expected to service the system themselves and that the system 100 eliminates the necessity of end users being required to periodically dissassemble the unit, replace an incandescent light bulb and reassemble the unit thereby eliminating the possibility of the end user being exposed to dangerous electrical shock hazards. The system 100 also eliminates the need for special electrical circuits for the purpose of monitoring an incandescent light bulb and providing an alert when the incandescent light bulb fails; eliminates the need for heavy, bulky and relatively expensive transformers; and also eliminates the need for special interlocks, disconnects, switches and special caution labels. From the foregoing description, it will also be appreciated that the compensation circuit incorporated in the system 100 compensates for both temperature changes and light output variations of the light emitting diode; that the anode and gate circuits of the programmable unijunction transistor cancel common mode power supply variations; and that the programmable unijunction transistor triggering circuit does not require the use of a capacitor.

In the event it is desired to utilize spaced multiple smoke detector and alarm units in a dwelling or other building, as for example from one to ten units, in a system embodying the present invention whereby all units in the system sound an alarm when one or more units in the system detect smoke, the anodes 144 of each of the silicon controlled rectifiers Q11 in each of the units may be electrically connected together in an uncomplicated and inexpensive manner, and all of the units will sound an alarm through the agency of the horn 115 in each unit if any one of the silicon controlled rectifiers Q11 in any unit fires in the manner previously described.

While preferred embodiments of the invention have been illustrated and described, it will be understood that various changes and modifications may be made without departing from the spirit of the invention.

What is claimed is:

1. In a smoke detector and alarm system, the combination including electrically activatable alarm means, an illuminating circuit including a light emitting diode, means providing a pulsating current supply for said light emitting diode whereby said light emitting diode emits pulsating light, a smoke sensing and compensation circuit including dual photo-electric means the electrical conductivity of each of which varies as a function of the amount of light impinging thereon, said dual photo-electric means being connected in series and being electrically connected to said means providing a pulsating current supply for said light emitting diode, said dual photo-electric means being mounted in proximity to said light emitting diode whereby light emanating from said light emitting diode impinges upon one of said dual photo-electric means at all times and impinges upon the other of said dual photo-electric means to change the conductivity of said other dual photo-electric means only when airborne particulate matter is present in the ambient atmosphere, solid state trigger means activatable in response to a differential in the conductivity of said dual photo-electric means, and solid state switching means controlling the activation of said alarm means and controlled by said trigger means.

2. The combination as set forth in claim 1 wherein said solid state trigger means includes a programmable unijunction transistor having a gate, said gate being connected to a junction between said dual photo-electric means.

3. The combination as set forth in claim 1 wherein solid state switching means includes a silicon controlled rectifier.

4. The combination as set forth in claim 1 wherein said alarm means includes an electric horn.

5. The combination as set forth in claim 1 including a snubber network having a capacitor and a resistor connected across said solid state switching means.

6. The combination as set forth in claim 1 including indicating means connected in series with said alarm means and in parallel with said switching means.

7. The combination as set forth in claim 1 including a transistor having an emitter, a collector and a base, said emitter being electrically connected in circuit with one of said dual photo-electric means, said collector being electrically connected in circuit with the other of said dual photo-electric means, and adjustable resistance means electrically connected in circuit with said base and across said means providing a pulsating current supply.

8. A smoke detector and alarm system, comprising, in combination, an alarm circuit including electrically actuated alarm means, an illuminating circuit including a light emitting diode, means providing a pulsating current supply for said light emitting diode whereby said light emitting diode emits pulsating light, a smoke sensing and compensation circuit including a pair of identical photo-electric cells the electrical conductivity of each of which varies as a function of the amount of light impinging thereon, said photo-electric cells being connected in series and being electrically connected to said means providing a pulsating current supply for said light emitting diode, said photo-electric cells being mounted in proximity to said light emitting diode whereby light emanating from said light emitting diode impinges upon one of said dual photo-electric cells at all times and impinges upon the other of said dual photo-electric cells to change the conductivity of said other photo-electric cell only when airborne particulate matter is present in the ambient atmosphere, a trigger circuit including solid state trigger means actuatable in response to a differential in the conductivity of said photo-electric cells, and a switching circuit including solid state switching means controlling the actuation of said alarm means and controlled by said trigger means.

9. The combination as set forth in claim 8 including an indicating circuit connected in series with said alarm means and in parallel with said switching means.

10. The combination as set forth in claim 9 wherein said solid state trigger means includes a programmable unijunction transistor having a gate, said gate being connected to a junction between said photo-electric cells.

11. The combination as set forth in claim 10 wherein said solid state switching means includes a silicon controlled rectifier having an anode, a cathode and a gate, said programmable unijunction transistor having an output connected to said rectifier gate, said anode and said cathode of said rectifier being connected in parallel with said indicating circuit.

12. The combination as set forth in claim 11 wherein said alarm means includes an electric horn having a coil, said anode of said rectifier also being connected to said coil.

13. The combination as set forth in claim 12 including a snubber network having a capacitor and a resistor connected in parallel with said solid state switching means.

14. The combination as set forth in claim 12 wherein said means providing a pulsating current supply for said light emitting diode includes diode means providing a half wave direct current supply for said light emitting diode whereby said light emitting diode emits pulsating light.

15. The combination as set forth in claim 12 wherein said indicating circuit includes a neon light connected in series with said coil and in parallel with said anode and said cathode of said silicon controlled rectifier.

16. The combination as set forth in claim 12 incluing a transistor having an emitter, a collector and a base, said emitter being electrically connected in circuit with one of said photo-electric cells, said collector being electrically connected in circuit with the other of said photo-electric cells, and adjustable resistance means electrically connected in circuit with said base and across said means providing a pulsating current supply.

17. A smoke detector and alarm system comprising, in combination, an alarm circuit including an electrically actuated horn having a coil, an illuminating circuit connected in parallel with said alarm circuit and including a light emitting diode, means providing a pulsating current supply for said light emitting diode whereby said light emitting diode emits pulsating light, a smoke sensing and compensation circuit incluing a pair of photo-electric cells the electrical conductivity of each of which increases as a function of the amount of light impinging thereon and mounted in proximity to said light emittting diode whereby light emanating from said light emitting diode impinges upon one of said dual photo-electric cells at all times and impinges upon the other of said dual photo-electric cells to change the conductivity of said other photo-electric cells only when airborne particulate matter is present in the ambient atmosphere, said photo-electric cells being connected in series and being electrically connected to said means providing a pulsating current supply for said light emitting diode, a trigger circuit including a programmable unijunction transistor activatable in response to a differential in the conductivity of said photo-electric cells, a switching circuit including a silicon controlled rectifier controlling the actuation of said horn and controlled by said programmable unijunction transistor, and an indicating circuit including a neon light connected in series with said coil and in parallel with said silicon controlled rectifier.

18. The combination as set forth in claim 17 wherein said silicon controlled rectifier includes an anode, a cathode and a gate, said programmable unijunction transistor having an output connected to said gate of said rectifier, said anode and said cathode of said rectifier being connected in parallel with said neon light.

19. The combination as set forth in claim 17 wherein said means providing a pulsating current supply for said light emitting diode includes diode means providing a half wave direct current supply for said light emitting diode whereby said light emitting diode emits pulsating light.

20. The combination as set forth in claim 17 including resistance means limiting the current in said indicating circuit.

21. The combination as set forth in claim 17 including means for adjusting the conductivity of said trigger circuit.

22. The combination as set forth in claim 17 including a snubber network having a capacitor and a resistor connected in parallel across said silicon controlled rectifier.

23. The combination as set forth in claim 17 including a transistor having an emitter, a collector and a base, said emitter being electrically connected in circuit with one of said photo-electric cells, said collector being electrically connected in circuit with the other of said photo-electric cells and adjustable resistance means electrically connected in circuit with said base and across said means providing a pulsating current supply.

24. A smoke detector and alarm system adapted to be connected to a main line source of AC current, said system comprising, in combination, an alarm circuit including electrically actuated alarm means, an illuminating circuit including a light emittng diode and diode means providing a half wave direct current supply for said light emitting diode whereby said light emitting diode emits pulsating light, a smoke sensing and compensation circuit including a pair of identical photo-electric cells the electrical conductivity of each of which varies as a function of the amount of light impinging thereon, said photo-electric cells being connected in series and being electrically connected to said diode means providing a half wave direct current supply for said light emitting diode, said photo-electric cells being mounted in proximity to said light emitting diode whereby light emanating from said light emitting diode impinges upon one of said dual photo-electric cells at all times and impinges upon the other of said dual photo-electric cells to change the conductivity of said other photo-electric cell only when airborne particulate matter is present in the ambient atmosphere, a trigger circuit including solid state trigger means actuatable in response to a differential in the conductivity of said photo-electric cells, and a switching circuit including solid state switching means controlling the actuation of said alarm means and controlled by said trigger means.

25. The combination as set forth in claim 24 including an indicating circuit connected in series with said alarm means and in parallel with said switching means.

26. A smoke detector and alarm system, comprising, in combination, an alarm circuit including electrically actuated alarm means, an illuminating circuit including a light emitting diode, means providing a pulsating current supply for said light emitting diode whereby said light emitting diode emits pulsating light, a smoke sensing and compensation circuit including a pair of identical photo-electric cells the electrical conductivity of each of which varies as a function of the amount of light impinging thereon, said photo-electric cells being connected in series and being electrically connected to said means providing a pulsatingg current supply for said light emitting diode, said photo-electric cells being mounted in proximity to said light emitting diode whereby light emanating from said light emitting diode impinges upon one of said dual photo-electric cells at all times and impinges upon the other of said dual photo-electric cells to change the conductivity of said other photo-electric cell only when airborne particulate matter is in the ambient atmosphere, a trigger circuit including solid state trigger means actuable in response to the opening of said illuminating circuit, and a switching circuit including solid state switching means controlling the actuation of said alarm means and controlled by said trigger means.

27. The combination as set forth in claim 26 including an indicating circuit connected in series with said alarm means and in parallel with said switching means.

28. The combination as set forth in claim 27 wherein said means providing a pulsating current supply for said light emitting diode includes means in said illuminating circuit providing a half wave direct current supply for said light emitting diode whereby said light emitting diode emits pulsating light.

29. The combination as set forth in claim 28, said system including a pair of terminals adapted to be connected to a main line source of AC current, said means for providing a half wave direct current supply including a diode disposed between one of said terminals and said light emitting diode, said light emitting diode also being electrically connected to the other of said pair of terminals.

30. The combination as set forth in claim 29 including a transistor having an emitter, a collector and a base, said emitter being electrically connected to one of said dual photo-electric cells, said collector being connected to the other of said dual photo-electric cells, adjustable resistance means electrically connected to said base and to said diode, and mens including an AC line bypass capacitor connected across said terminals and effective to prevent high frequency line noise from reaching said system.

* * * * *